US008851094B2

(12) United States Patent
Kuma

(10) Patent No.: US 8,851,094 B2
(45) Date of Patent: Oct. 7, 2014

(54) CANE

(75) Inventor: Shigehito Kuma, Tokyo (JP)

(73) Assignee: MARUFUJI, Inc., Tokyo (JP)

( * ) Notice: Subject to any disclaimer, the term of this patent is extended or adjusted under 35 U.S.C. 154(b) by 391 days.

(21) Appl. No.: 13/130,419

(22) PCT Filed: Jun. 11, 2010

(86) PCT No.: PCT/JP2010/059900

§ 371 (c)(1),
(2), (4) Date: May 20, 2011

(87) PCT Pub. No.: WO2011/121804

PCT Pub. Date: Oct. 6, 2011

(65) Prior Publication Data

US 2012/0222714 A1 Sep. 6, 2012

(51) Int. Cl.

| | |
|---|---|
| ***A45B 9/04*** | (2006.01) |
| ***A45B 9/02*** | (2006.01) |
| *A45B 9/00* | (2006.01) |

(52) U.S. Cl.

CPC ... *A45B 9/02* (2013.01); *A45B 9/04* (2013.01); *A45B 2009/005* (2013.01)

USPC ..... 135/77; 135/75

(58) Field of Classification Search

USPC ..... 135/75, 77, 84, 86

See application file for complete search history.

(56) References Cited

U.S. PATENT DOCUMENTS

| | | | | |
|---|---|---|---|---|
| 1,197,375 | A * | 9/1916 | Hoff | 135/69 |
| 4,411,284 | A * | 10/1983 | Opitz | 135/81 |
| 4,887,625 | A * | 12/1989 | Archer | 135/75 |
| 6,085,766 | A * | 7/2000 | Geary | 135/75 |
| 6,216,713 | B1 | 4/2001 | Kennan | |
| 6,341,614 | B1 * | 1/2002 | Tucker et al. | 135/75 |
| 7,841,353 | B2 | 11/2010 | Lee | |
| 8,500,357 | B2 | 8/2013 | Stahle | |
| 2006/0254632 | A1 | 11/2006 | Willis | |
| 2006/0254633 | A1 | 11/2006 | Willis | |
| 2008/0041432 | A1 | 2/2008 | Willis | |
| 2009/0250088 | A1 | 10/2009 | Gibbons et al. | |

FOREIGN PATENT DOCUMENTS

| | | |
|---|---|---|
| JP | 1-134026 | 11/1989 |
| JP | 3-72715 | 7/1991 |
| JP | 05-007505 | 1/1993 |
| JP | 7-49004 | 5/1995 |

(Continued)

OTHER PUBLICATIONS

International Search Report issued in corresponding application PCT/JP2010/059900, completed on Aug. 31, 2010 and mailed Sep. 14, 2010.

(Continued)

*Primary Examiner* — David R Dunn

*Assistant Examiner* — Danielle Jackson

(74) *Attorney, Agent, or Firm* — Griffin & Szipl, P.C.

(57) ABSTRACT

A cane that can efficiently use a rubber tip (60) is provided from the aspect of ecology. The cane comprises a grip part (10) located at the upper end of a first cane body (20), the rubber tip (60) located at the lower end of the first cane body (20), and a button (52) and holes (36*a*-36*d*) for rotating the grip part (10) and rubber tip (60) in four steps, wherein the button (52) and holes (36*a*-36*d*) also serve as a fixing part for fixing the grip part (10) and rubber tip (60) after those have been rotated.

2 Claims, 10 Drawing Sheets

(56) References Cited

FOREIGN PATENT DOCUMENTS

| | | | |
|---|---|---|---|
| JP | 1995-49004 | | 5/1995 |
| JP | 10-225313 | A | 8/1998 |
| JP | 2002-112815 | A | 4/2002 |
| JP | 2003-164309 | | 6/2003 |
| JP | 2006-280837 | | 10/2006 |
| WO | 99/08645 | | 2/1999 |
| WO | 2009/102260 | A1 | 8/2009 |

OTHER PUBLICATIONS

Search Report issued in corresponding European application 10848977.44, completed Jan. 27, 2012 and mailed Feb. 3, 2012.

Office Action issued in corresponding European application 10848977.44, dated Apr. 26, 2012.

Office Action issued in co-pending related U.S. Appl. No. 13/910,614 on Sep. 12, 2013.

* cited by examiner

CANE

This is a National Phase Application in the United States of International Patent Application No. PCT/JP2010/59900, filed Jun. 11, 2010, which claims priority on Japanese Patent Application No. 2010-075772, filed Mar. 29, 2010. The entire disclosures of the above patent applications are hereby incorporated by reference.

FIELD OF THE INVENTION

The present invention is related to a cane, and in particular, it is related to a cane to assist walking.

BACKGROUND OF THE INVENTION

Conventionally, as a cane that can steplessly adjust the length, there is, for example, a cane comprising a length adjuster. In this adjuster, a screw body provided in a protruding condition integrally with the screw shaft at the center of a cone having a conical periphery, is secured to the upper end of the lower pipe, and the screw shaft of this screw body is screwed together with a cylindrical brake member having an elasticity of opening and expanding in the circumferential direction. In addition, an eccentrically rotatable cam disk is provided, and the cam disk is attached by pressure against the inner periphery of the upper pipe by rotating the lower pipe so as to brake the rotation of the upper pipe. At the same time, the upper pipe and the lower pipe are configured to be fixed with each other by attaching by pressure against the inner periphery of the upper pipe through opening and expanding the brake member with the conical periphery of the cone.

PRIOR ART DOCUMENT

Patent Document

Patent Document 1: JPB1995-49004

SUMMARY OF THE INVENTION

Problem to be Solved by the Invention

However, regarding the cane disclosed in Patent Document 1, there is no description or suggestion about the countermeasure for the case that a rubber tip provided at the lower end of the lower pipe has been worn out. Since a specific part of the rubber tip usually contacts with the ground etc., only the corresponding part is worn out. In such a case, it is compelled to replace the rubber tip in a relatively short period of time. This is not desirable from the aspect of ecology.

Therefore, the problem to be solved by the present invention is to provide a cane that can efficiently use the rubber tip.

Means of Solving the Problem

In order to solve the above problem, the cane according to the present invention comprises:

a grip part located at the upper end of the cane body;

a rubber tip located at the lower end of the cane body;

a rotating part that rotates the grip part and rubber tip in four steps; and a fixing part that fixes the grip part and rubber tip after those have been rotated by the rotating part.

DESCRIPTION OF SYMBOLS

10 Grip part
20 The first cane body
30 The second cane body
40 Cap
50 Spring
60 Rubber tip

DESCRIPTION OF EMBODIMENTS

Referring to drawings, embodiments according to the present invention is described hereinafter. Wherein like numerals denote like parts in each drawing. Note that some of the scales of the drawings may be different from those based on the actual size for convenience of explanation. Furthermore, an element explained in one drawing can be replaced with the corresponding element in another drawing.

Embodiment 1

Figure 1:
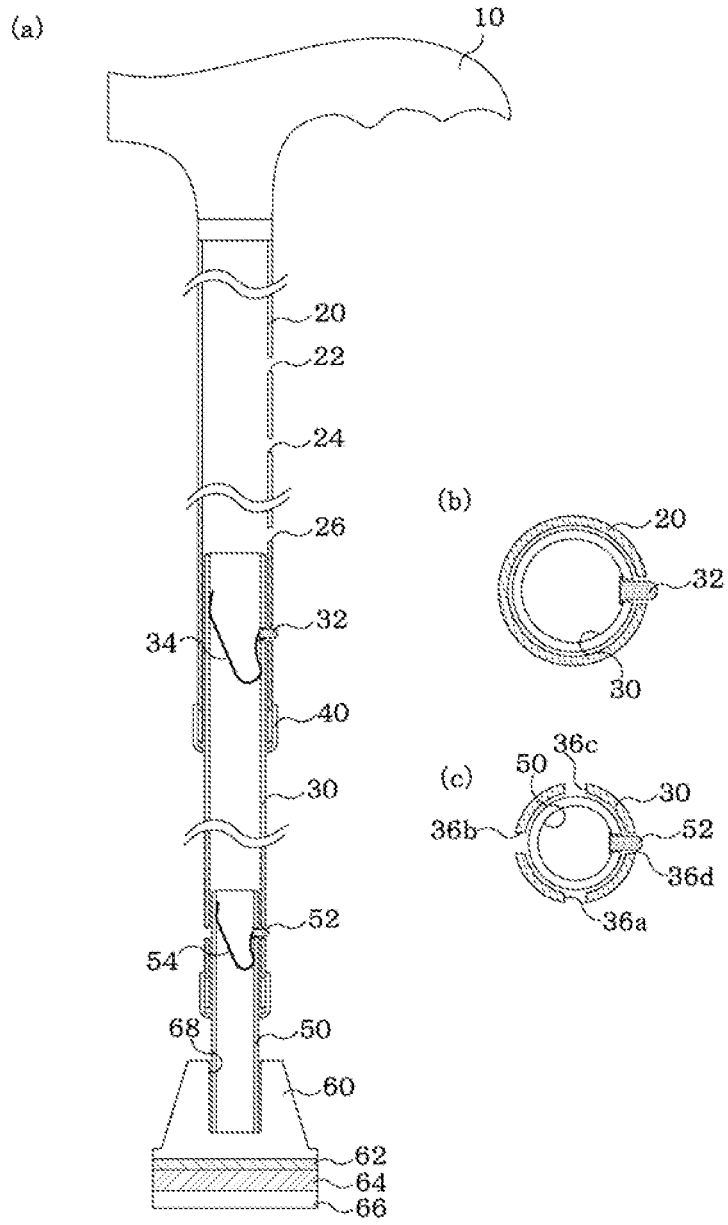
FIG. 1 shows a schematic diagram of the cane of Embodiment 1 according to the present invention.

FIG. 1(*a*) shows a schematic diagram of the cane of Embodiment 1 according to the present invention. FIG. 1(*b*) shows a section view of the button 32 of FIG. 1(*a*). FIG. 1(*c*) shows a section view of the button 52 of FIG. 1(*a*).

As shown in FIG. 1(*a*), the cane of this embodiment is provided with a grip part 10 located at the upper end thereof. A pipe-shaped first cane body 20 is connected to the lower end of the grip part 10. The first cane body 20 is provided with a plurality of holes 22, 24 and 26 along the axial direction thereof.

A second cane body 30 which is likewise in a pipe shape is located inside the first cane body 20, and a third cane body 50 is located inside the second cane body 30. The upper part of the second cane body 30 is provided with a button 32, which fits into any one of the plurality of holes 22, 24 and 26, and is also provided with a spring 34, which defines the location of the button 32. The location to fit the button 32 may be determined in accordance with the required length of the cane. That is to say, the length of the cane can be changed by the hole 22 etc. and the button 32.

FIG. 1(*b*) shows a status that the button 32 is fit into a hole. Once the button 32 is fit into any one of the holes 22, 24 and 26, the connection between the first cane body 20 and the second cane body 30 is achieved. In addition, a cap 40 for retaining the connection is attached to the connection part between the first cane body 20 and second cane body 30 so that the connection between the first cane body 20 and second cane body 30 will not be disconnected even if unexpected external force is applied to the button 32.

The upper part of the third cane body 50 is provided with a button 52, which fits into any one of a plurality of holes (depressions) 36*a*-36*d*, and is also provided with a spring 54, which defines the location of the button 52. The location to fit the button 52 may be determined in accordance with the reduced amount at the bottom of the rubber tip 60.

FIG. 1(*c*) shows a status that the button (protrusion) 52 is fit into the hole 36*d*. Once the button 52 is fit into any one of the holes 36*a*-36*d*, the connection between the second cane body 30 and the third cane body 50 is achieved. The holes 36*a*-36*d* are circumferentially aligned in the second cane body 30.

The rubber tip 60 is attached to the lower end of the third cane body 50. The rubber tip 60 is provided with a groove part 68 that receives the third cane body 50. Information areas 62, 64 and 66 with, for example, a different color from each other are formed in the side of the rubber tip 60 to inform the indication for changing the location of the button 52.

Next, an example of the typical use of the cane of this embodiment is described. When a user walks along holding the grip part 10, a specific part of the rubber 60 is worn out by the friction with the ground etc. as described above. Then, when the information area 64 appears due to a partial wear on the information area 66, the button 52 is pushed down, and the rubber tip 60 side and the third cane body 50 are rotated by, for example, 90 degrees (or 180 degrees) to change the location of the button 52 in relation to the holes 36*a*-36*d*.

Therefore, when subsequently using the cane, a new part of the information area 66 of the rubber tip 60 hits the ground etc. Likewise, when the information area 64 appears due to the subsequent use, the button 52 is pushed down, and the rubber tip 60 side and the third cane body 50 are rotated by, for example, 90 degrees to change the location of the button 52 in relation to the holes 36*a*-36*d*. Although it depends on how to use the cane, typically after three rotations, if the cane is used for a while, all of the information area 66 will be worn out.

Hereafter, likewise, when the information area 62 appears due to a partial wear on the information area 64, the button 52 is pushed down, and the rubber tip 60 side and the third cane body 50 can be rotated by, for example, 90 degrees (or 180 degrees) to change the location of the button 52 in relation to the holes 36*a*-36*d*.

In such a case, the necessity of replacing the rubber tip 60 in a relatively short period of time due to local wear can be avoided.

Embodiment 2

Figure 2:
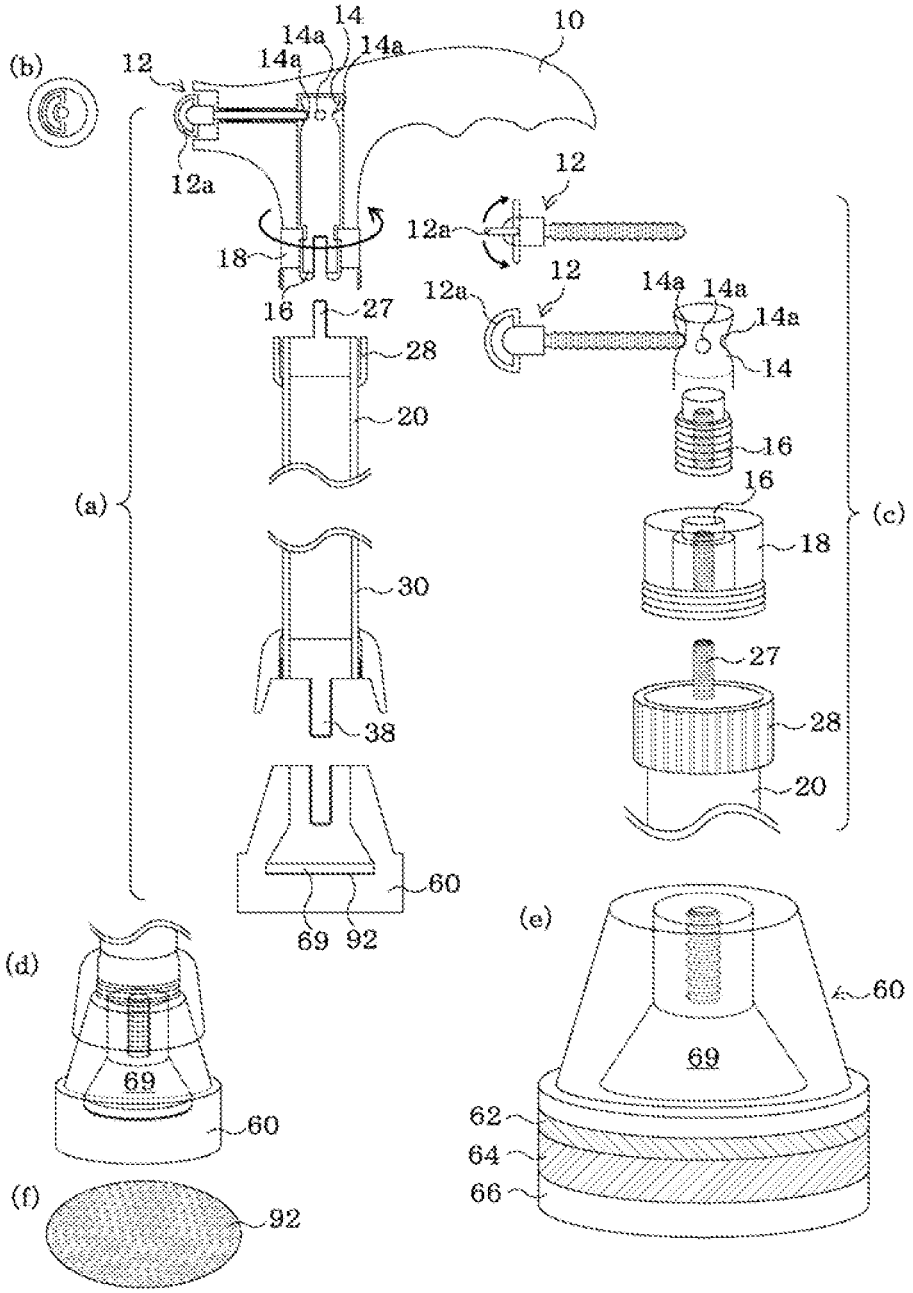
FIG. 2 shows a schematic diagram of the cane of Embodiment 2 according to the present invention.

FIG. 2(*a*) shows a schematic section view of the cane of Embodiment 2 according to the present invention. FIG. 2(*b*) shows an enlarged side view of a clamp part (protrusion) 12 of FIG. 2(*a*). FIG. 2(*c*) shows an exploded perspective view of the grip part 10 of FIG. 2(*a*). FIGS. 2(*d*)-2(*f*) show explanatory drawings of the rubber tip 60 of FIG. 2(*a*).

The cane shown in FIG. 2(*a*) is significantly different from that of FIG. 1 in terms of the following two points. First, this embodiment is designed so that the grip part 10 and the first cane body 20 rotate in relation to each other. Second, a replacement information plate 92 made of metal is provided inside the rubber tip 60.

Firstly, the first difference is described. The grip part 10 is provided with a first opening of which the side connected to the first cane body 20 is relatively large, and the upper side of the first opening in the drawing is provided with a relatively small second opening in the direction perpendicular to the opening direction of the first opening.

A receiving part 14 is attached to the first opening via an adhesive etc. A screw hole is formed in the second opening, and a clamp part 12 comprising a screw-threaded shaft is attached to this. As shown in FIG. 2(*c*), the other end of the shaft of the clamp part 12 is provided with a knob part 12*a* that is put up straight when rotating the clamp part 12 and is folded down when using the cane.

In addition, a constriction is formed in the upper part of the receiving part 14, wherein a plurality of grooves (depressions) 14*a* are formed (for example, four). The clamp part 12 and the receiving part 14 are joined with each other by receiving the tip of the shaft of the clamp part 12 into any one of the grooves 14*a* formed in this constricted part. A first connection part 16 is provided at the lower end of the receiving part 14 via a base 18. The upper side of the base 18 is fixed to the bottom of the grip part 10 with an adhesive etc. In addition, a screw hole is formed in the bottom of the first connection part 16, realizing the connection between the grip part 10 and the first cane body 20 together with the second connection part 27 on the first cane body 20 side.

The second connection part 27 is attached to the upper part of the first cane body 20 via an adhesive etc or by press-fitting. A screw part that extends upward is formed at the center of the top end of the second connection part 27, and said screw part is screwed into the screw hole in the first connection part 16.

This embodiment is designed to retain the joint between the first connection part 16 and the second connection part 27. Specifically, a screw-threaded section is formed in the outer circumference of the lower end of the base 18. In contrast, a cap part 28 is placed along the outer circumference of the second connection part 27, and a screw-threaded section is formed along the inner circumference of this part. Therefore, the first connection part 16 and the second connection part 27 are prevented from coming loose from each other by connecting these screw-threaded sections with each other.

Next, an example of the typical use of the cane of this embodiment is described. When a specific part of the rubber tip 60 has been worn out due to wearing, firstly, the knob part 12*a* of the clamp part 12 is put up straight and then the clamp part is turned anticlockwise so that the connection between the clamp part 12 and the receiving part 14 is released. Next, the grip part 10 and the first cane body 20 are rotated from each other by about 90 degrees. Subsequently, the connection between the clamp part 12 and the receiving part 14 is resumed by rotating the clamp part 12 clockwise, and then the knob part 12*a* is folded down. Through the above series of operations, the setting position of the rubber tip 60 in relation to the ground etc. can be changed.

Next, the second difference from the cane of Embodiment 1 is described. As shown in FIGS. 2(*d*)-2(*f*), a cane body receiving part 69 having a replacement information plate 92 located at the bottom is provided inside the rubber tip 60 in the manufacturing stage of the rubber tip 60. The rubber tip 60 is manufactured by using, for example, a metal mold in which a clamp part for the replacement information plate 92 and the cane body receiving part 69 has been formed. A screw hole is formed at the center of the upper part of the cane body receiving part 69.

In addition, a mesh pattern is formed in the bottom surface of the replacement information plate 92 to prevent from slipping off even if it is exposed and contacts with the ground etc. due to wear on the rubber tip 60. When the rubber tip 60 is worn out to the degree that the replacement information plate 92 is exposed, the contact between the replacement information plate 92 and the ground etc. causes a metallic sound, allowing to encourage the replacement of the rubber tip 60.

In contrast, a third connection part 38 is attached to the lower end of the second cane body 30 via an adhesive etc. or by press-fitting. A screw part is formed at the center of the lower part of the third connection part 38, realizing the mutual connection with the cane body receiving part 69 by screwing together.

For example, the bottom end part of the third cane body 30 may be screw-threaded and the screw hole may be formed in the inner wall of the cane body receiving part 69 without providing the third connection part 38.

Embodiment 3

Figure 3:
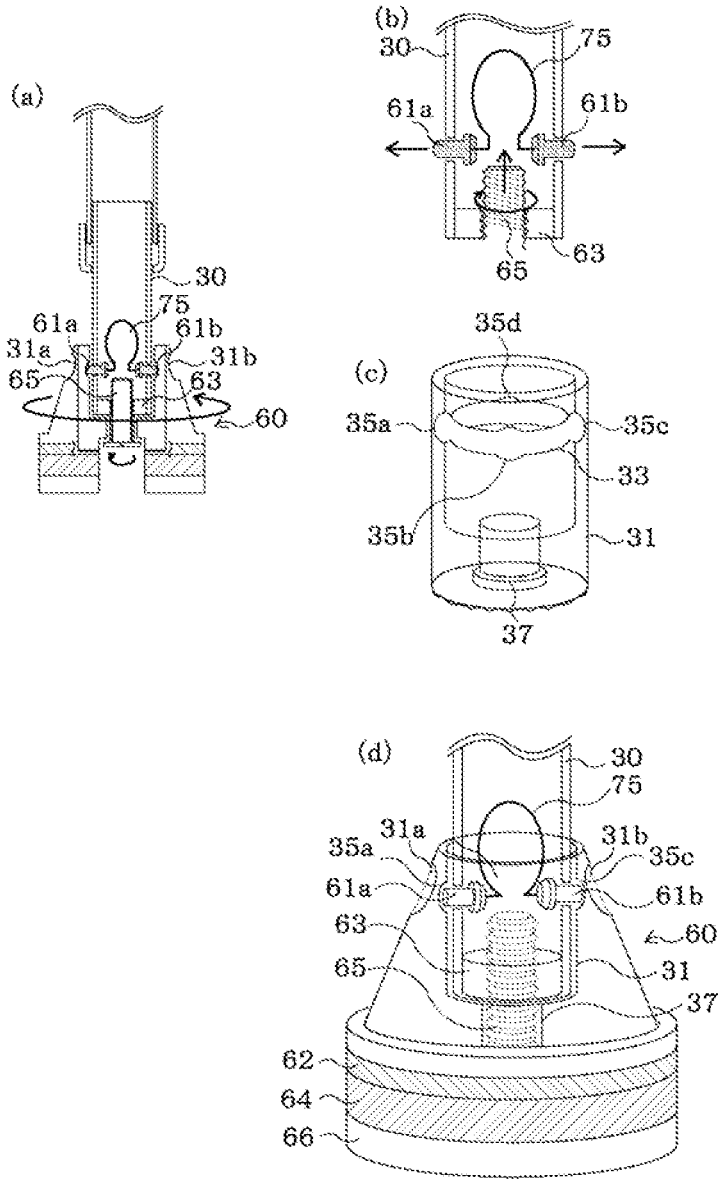
FIG. 3 shows a schematic diagram of the cane of Embodiment 3 according to the present invention.

FIG. 3(*a*) shows a schematic section view of the lower part of the cane of Embodiment 3 according to the present invention. FIG. 3(*b*) shows an enlarged view of the buttons 61*a* and 61*b* (protrusions) of FIG. 3(*a*). FIG. 3(*c*) shows an enlarged perspective view of the rotation auxiliary part 31 of FIG. 3(*a*). FIG. 3(*d*) shows an enlarged perspective view of the rubber tip 60 of FIG. 3(*a*).

As shown in FIG. 3(*a*), the cane of this embodiment is designed so that the second cane body 30 and the rubber tip 60 rotate in relation to each other. In addition, this cane is designed so that the second cane body 30 and the rubber tip 60 can rotate in relation to each other by pressing the buttons 61*a* and 61*b* through the side of the rubber tip 60.

The rubber tip 60 is provided with a step-shaped cylindrical cavity, and its upper part is attached to the rotation auxiliary part 31 made of rubber or resin, etc. by press-fitting. A through-hole is formed in the center of the bottom of the rotation auxiliary part 31, and the rubber tip 60 and the second cane body 30 are fixed with each other by a screw 65 therethrough.

As explained in FIG. 1, for example, four holes are formed in the circumference of the second cane body 30. Among them, the buttons 61*a* and 61*b* are received by two opposed holes. The locations of the buttons 61*a* and 61*b* are mutually defined by a spring 75. A screw receiving part 63 that is screwed with a screw 65 is press-fitted to the bottom of the second cane body 30.

In addition, dents 31*a* and 31*b* are formed at the locations corresponding to the buttons 61*a* and 61*b* in the slope of the rubber tip 60 so that the buttons 61*a* and 61*b* can be easily pushed down.

As shown in FIG. 3(*c*), an approximate cylindrical cavity is formed in the rotation auxiliary part 31. A through-hole 37 for putting the screw 65 through is formed in the bottom of the approximate cylindrical cavity, and button receiving parts 35*a*-35*d* are formed in the upper part of the approximate cylindrical cavity to receive the buttons 61*a* and 61*b* when the cane is used. The button receiving parts 35*a*-35*d* are dents larger than the buttons 61*a* and 61*b*, and a groove 33 connects between the button receiving parts 35*a*-35*d* so that the tips of the button 61*a* and 61*b* are guided as the second cane body 30 and the rubber tip 60 are rotated.

Next, an example of the typical use of the cane of this embodiment is described. When a specific part of the rubber tip 60 has been worn out due to wearing, the dents 31*a* and 31*b* are pushed down. Thereby, the rubber tip 60 presses down the rotation auxiliary part 31, and then the rotation auxiliary part 31 presses the buttons 61*a* and 61*b*. Therefore, the connection between the second connection part 30 and the buttons 61*a* and 61*b* is released. Next, in this status, the second connection part 30 and the rubber tip 60 are rotated from each other, for example, by about 90 degrees.

Thereby, for example, when the buttons 61*a* and 61*b* have been received by the button receiving parts 35*a* and 35*c* before a rotation, the tip of the buttons 61*a* and 61*b* will reach the button receiving parts 35*b* and 35*d* via the groove 33 due to the rotation. In so doing, the buttons 61*a* and 61*b* result in moving toward the repulsive direction from each other by the spring 75, and thus are received by the button receiving parts 35*b* and 35*d*. Through the above series of operations, the setting position of the rubber tip 60 in relation to the ground etc. can be changed.

Embodiment 4

Figure 4:
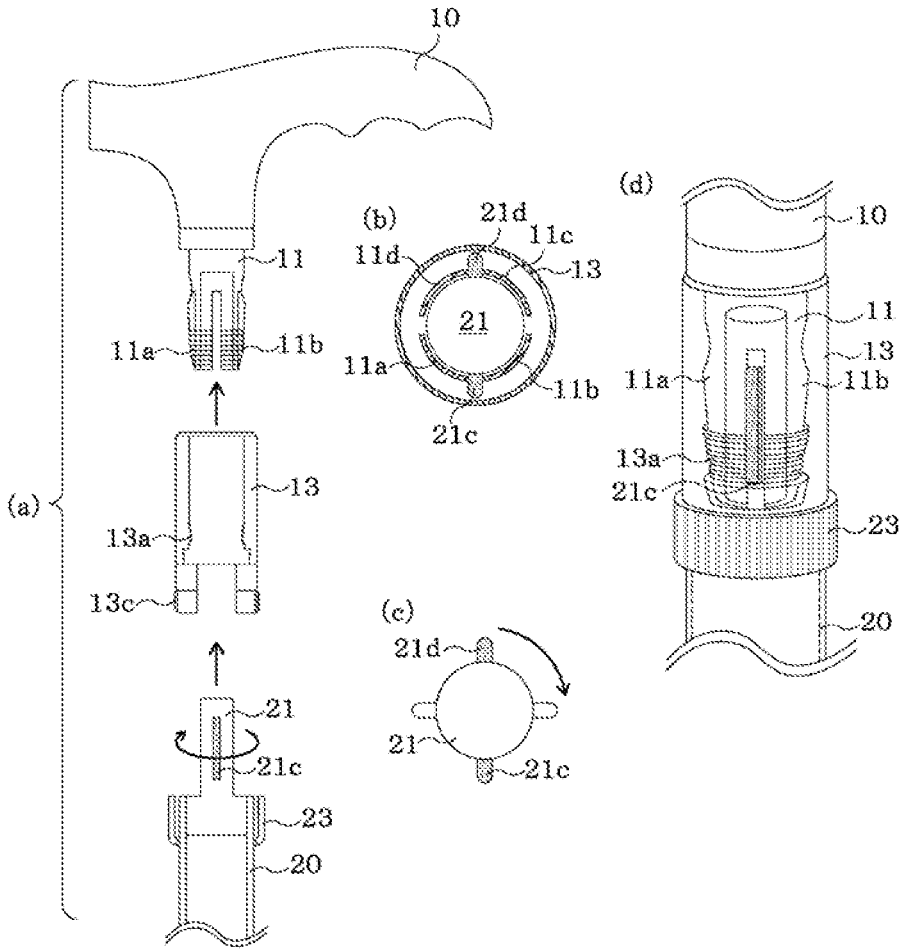
FIG. 4 shows a schematic diagram of the cane of Embodiment 4 according to the present invention.

FIG. 4(*a*) shows a schematic exploded section view of the upper part of the cane of Embodiment 4 according to the present invention. The cane of this embodiment is designed so that the grip part 10 and the first cane body 20 rotate in relation to each other. FIG. 4(*d*) shows a schematic perspective view of the upper part of the cane of this embodiment. FIG. 4(*c*) shows a section view of the nail part (protrusion) 21*c* of FIG. 4(*d*). FIG. 4(*d*) shows a section view of the nail part 21*c* of FIG. 4(*a*).

As shown in FIG. 4(*a*), the lower end of the grip part 10 is connected to a receiving part 11. The receiving part 11 has four tapered prongs 11*a*-11*d* with generally narrower tips. The cane body prongs 11*a*-11*d* will receive the nail parts 21*c* and 21*d* with the gaps between the prongs (depressions) as described below. The outer surfaces of the prongs 11*a*-11*d* have been screw-threaded, and are screwed with the screw part 13 described below.

The screw part 13 has an approximate cylindrical shape, and the middle section of its inner wall has a shape corresponding to the tapered shape of the prongs 11*a*-11*d*, wherein a screw-threaded section is formed in the middle section of its inner wall to be screwed with the prongs 11*a*-11*d*. In addition, a screw-threaded section 13*b* is formed in the lower part of the outer wall of the screw part 13 for receiving the cap part 23 described below.

As shown in FIGS. 4(*b*) and 4(*d*), the cane of this embodiment is in a mode that, for example, the nail part 21*c* is located in between the prongs 11*a* and 11*b*, and the nail part 21*d* is located in between the prongs 11*c* and 11*d*, and then the screw part 13 is screwed onto the receiving part 11. In so doing, each of the prongs 11*a*-11*d* of the receiving part 11 is tightened up toward the shaft center of the receiving part 11 by the inner wall of the screw part 13. As a result of this, the nail part 21*c* is bound between the prongs 11*a* and 11*b*, while the nail part 21*d* is bound between the prongs 11*c* and 11*d*, and thus the connection between the grip part 10 and the first cane body 20 can be realized.

Just like the cap part 28 of FIG. 2, the cap part 23 plays a role of retaining the connection between the grip part 10 and the first cane body 20, and prevents those from coming loose from each other.

Next, an example of the typical use of the cane of this embodiment is described. When a specific part of the rubber tip 60 has been worn out due to wearing, firstly, the cap part 23 is made loose and then the screw part 13 is also made loose. As a result of this, the binding of the nail part 21*c* by the prongs 11*a* and 11*b*, and the binding of the nail part 21*d* by the prongs 11*c* and 11*d* are released.

Then, the grip part 10 and the first cane body 20 are detached from each other, and as shown in FIG. 4(*c*), the grip part 10 and the first cane body 20 are subsequently rotated by, for example, about 90 degrees in relation to each other, and then the grip part 10 and the first cane body 20 are put back together again. As a result, the nail part 21*c* is located between the prongs 11*a* and 11*d*, and the nail part 21*d* is located between the prongs 11*b* and 11*d*.

Subsequently, as the screw part 13 is also tightened up, the nail part 21*c* is bound by the prongs 11*a* and 11*d*, and the nail part 21*d* is bound by the prongs 11*b* and 11*d*. Then, the cap part 23 is tightened up. Through the above series of operations, the setting position of the rubber tip 60 in relation to the ground etc. can be changed.

Embodiment 5

Figure 5:
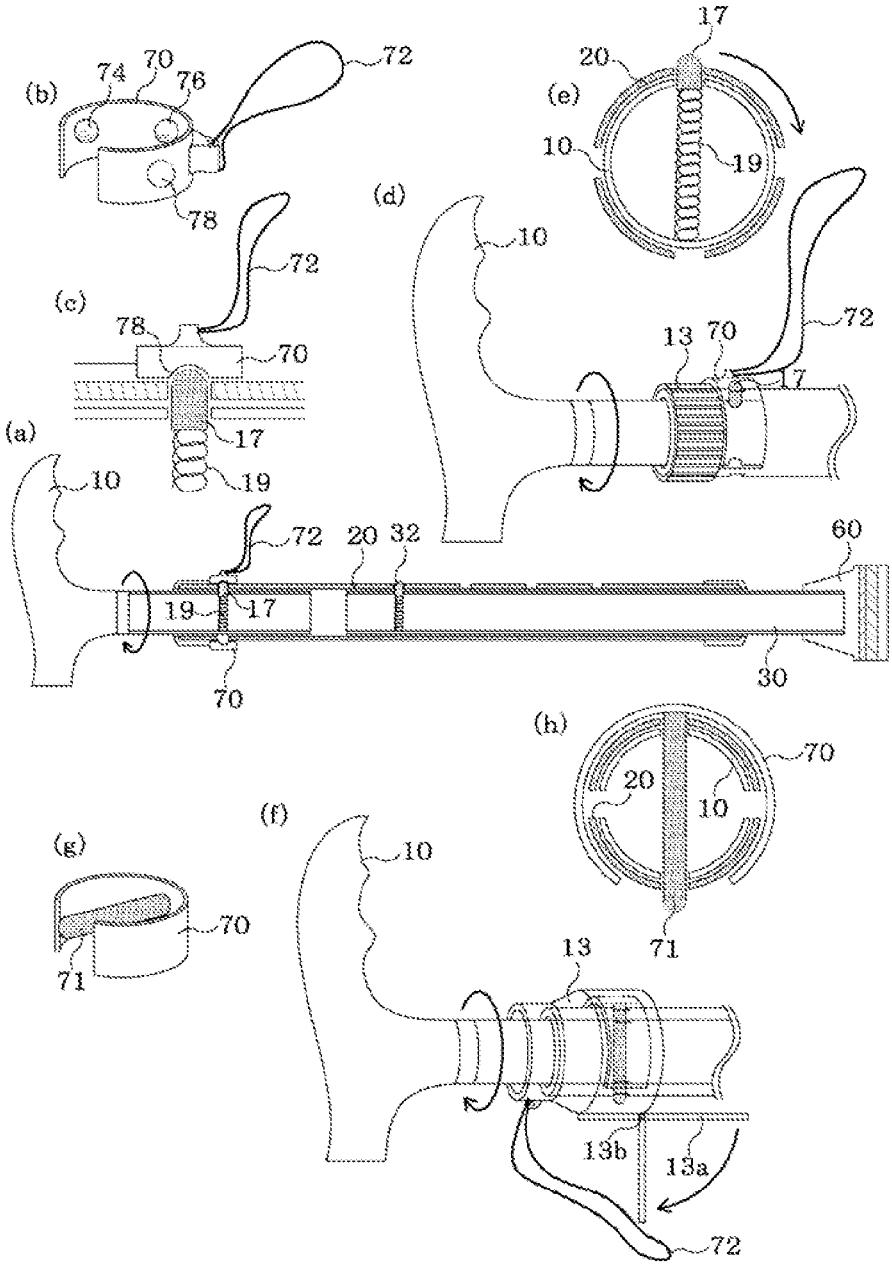
FIG. 5 shows a schematic diagram of the cane of Embodiment 5 according to the present invention.

FIG. 5(*a*) shows a schematic exploded section view of the upper part of the cane of Embodiment 5 according to the present invention. The cane of this embodiment is designed so that the grip part 10 and the first cane body 20 rotate in relation to each other. FIG. 5(*b*) shows a schematic perspective view of the cover 70 fitted on the cane of FIG. 5(*a*). FIG. 5(*d*) shows a perspective view of the upper part of FIG. 5(*a*). FIG. 5(*c*) shows an enlarged section view of the cover 70 of FIG. 5(*a*). FIG. 5(*e*) shows a section view of the button 17 (protrusion) of FIG. 5(*c*).

As shown in FIGS. 5(*a*) and 5(*d*), the grip part 10 is provided with a button 17 for rotating the grip part 10 and the first cane body 20, and a spring 19 for defining the location of the button 17. The first cane body 20 is fitted with the cover 70 to cover the button 17 for preventing external force from being applied. In addition, the cover 70 is fitted with a strap 72 to remove it from the first cane body 20.

As shown in FIG. 5(*b*), dents 74, 76 and 78 that correspond to the button 17 are formed in the inner wall of the cover 70. Although the number of the dents in the inner wall of the cover 70 is set to three as an example, the number may be more or less than this as long as at least one dent is formed. The reason why this embodiment sets the number of the dents to three is to simplify the alignment of any one of the dents with the button 17 when fitting the cover 70. FIG. 5(*c*) shows a status that the dent 78 and the button 17 have been nicely aligned with each other.

A section view shown in FIG. 5(*e*) is the one that corresponds to FIG. 1(*c*), and this embodiment also allows to change the setting position of the rubber tip 60 in relation to the ground etc. by rotating the grip part 10 and the first cane body 20 while the button 17 is pushed down.

However, as substitute for the button 17 and spring 19 shown in FIG. 5(*a*) and other figures, the cap 70 may be provided with a shaft (protrusion) 71. In this case, at lease one pair of through-holes through which the shaft 71 goes (two pairs of through-holes are shown herein) may be formed in prescribed positions in the grip part 10, and in addition, also in the first cane body 20 in the positions corresponding to said through-holes, two pairs of through-holes through which the shaft 71 goes may be formed. Also in such a case, the shaft 71 is once taken out from the through-holes, and then the grip part 10 and the first cane body 20 may be rotated by, for example, 90 degrees, and then the shaft 71 may be inserted into the through-holes again.

In addition, this embodiment is designed to use an auxiliary cap 13 for preventing the cap 70 from falling off the cane in the case that the cane comprises the cap 70 having the shaft 71. Specifically, it is designed to cover the cap 70 with the auxiliary cap 13.

The auxiliary cap 13 is provided with a lever 13*a* for tightening and releasing the cap 70, and when the lever 13*a* is set in parallel to the axial direction of the cane around the rotation axis 13*b* as the center, the cap 70 is tightened up, and when the lever 13*a* is set perpendicular to the axial direction of the cane, the tightening for the cap 70 is released.

Embodiment 6

Figure 6:
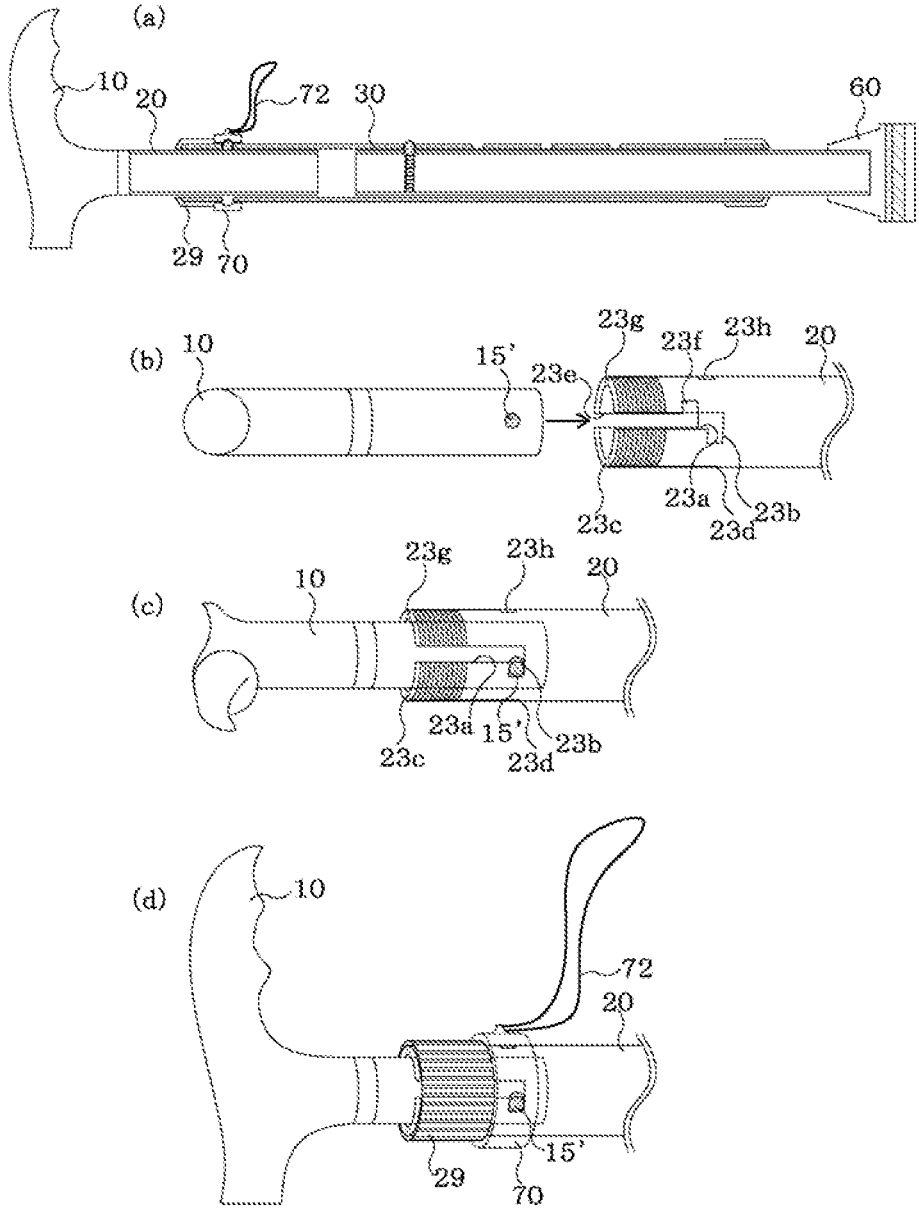
FIG. 6 shows a schematic diagram of the cane of Embodiment 6 according to the present invention.

FIG. 6(*a*) shows a schematic section view of the cane of Embodiment 6 according to the present invention. The cane of this embodiment is designed so that the grip part 10 and the first cane body 20 rotate in relation to each other. FIG. 6(*d*) shows a schematic perspective view of the upper part of the cane of this embodiment. FIGS. 6(*b*), 6(*c*) and 6(*d*) show diagrams for explaining the method for connecting between the grip part 10 and the first cane body 20.

As shown in FIGS. 6(*a*) and 6(*d*), the cane of this embodiment also has the first cane body 20 fitted with the cover 70 just like the one in Embodiment 5. A retaining cap 29 for retaining the connection between the grip part 10 and the first cane body 20 is located adjacent to the cover 70.

As shown in FIG. 6(*b*), the grip part 10 is provided with a protrusion 15'. The protrusion 15' has a function corresponding to the button 17. That means, the protrusion 15' is a part for realizing the rotation of the grip part 10 and the first cane body 20.

In addition, for example, four guide parts 23*a*, 23*c*, 23*e* and 23*g* are formed in the first cane body 20, wherein the protrusion 15' is inserted. The guide parts 23*a* etc. are slightly wider than the diameter of the protrusion 15'. Protrusion receivers (depressions) 23*b*, 23*d*, 23*f* and 23*h* are integrally formed in the guide parts 23*a* etc. The protrusion receivers 23*b* etc. are slightly narrower than the diameter of the protrusion 15'.

As shown in FIG. 6(*c*), the protrusion 15' is inserted into any one of the guide parts, and subsequently, it is rotated toward its accompanied protrusion receiver so that the grip part 10 is connected to the first cane body 20. In this status, when the retaining cap 29 is screwed onto the screw-threaded section at the upper end of the first cane body 20, the protrusion 15' is prevented from falling off the protrusion receiver.

Although FIG. 6 shows an example wherein the grip part 10 is provided with the protrusion 15' while guide parts 23*a* etc. are formed in the first cane body 20, reversely, the guide parts 23*a* etc. may be formed in the grip part 10 while the first cane body 20 is provided with the protrusion 15'.

Embodiment 7

Figure 7:
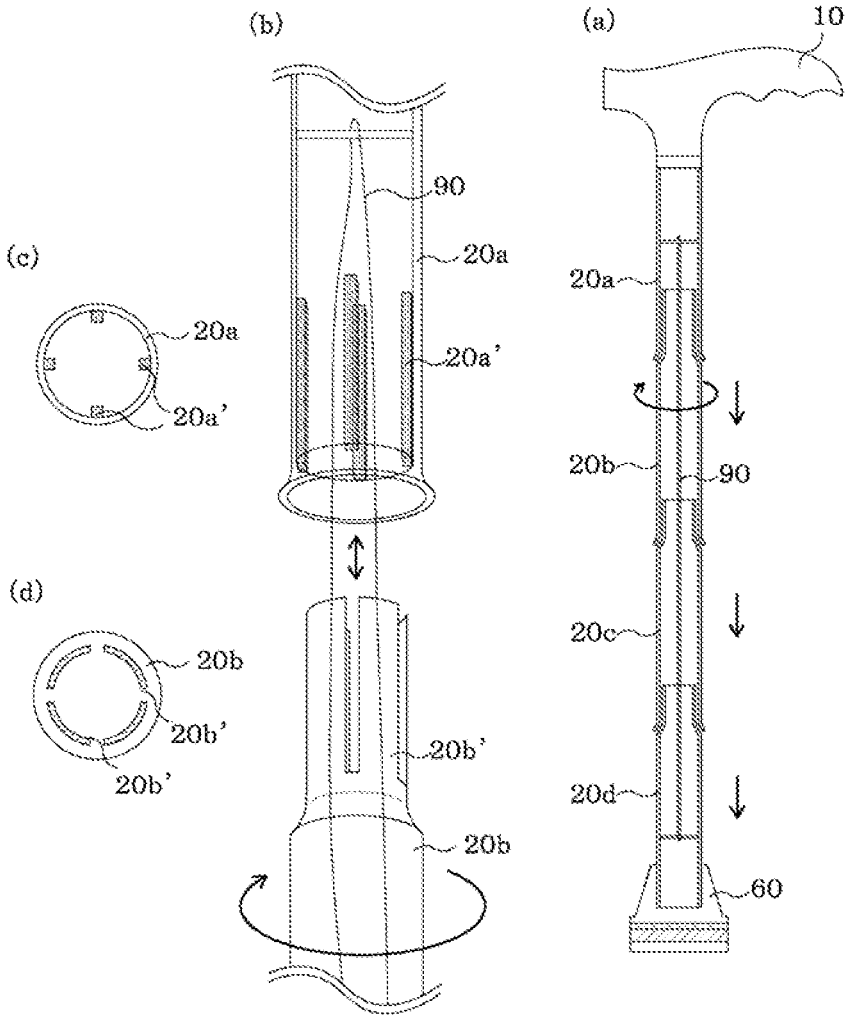
FIG. 7 shows a schematic diagram of the cane of Embodiment 7 according to the present invention.

FIG. 7(*a*) shows a schematic section view of the cane of Embodiment 7 according to the present invention. A so-called folding cane is shown in this figure. This folding cane has a grip part 10 to which a first cane body 20*a* to a fourth cane body 20*d* are sequentially connected. The grip part 10 and the cane body 20*d* are connected with a rubber 90.

When folding up the cane, the first cane body 20*a* and the second cane body 20*b* are pulled apart, and the second cane body 20*b* and the third cane body 20*c* are pulled apart, and then the third cane body 20*c* and the fourth cane body 20*d* are pulled apart so that each of them can be folded up. In so doing each part that constitutes the cane will not be separated from each other due to the presence of the rubber 90. When assembling the cane, this series of operations may be followed the other way around.

FIG. 7(*b*) shows an exploded perspective view of the connection part between the first cane body 20*a* and the second cane body 20*b*. FIG. 7(*c*) shows a section view of the first cane body 20*a* side of FIG. 7(*b*). FIG. 7(*d*) shows a section view of the second cane body 20*b* side of FIG. 7(*b*).

As shown in FIGS. 7(*b*) and 7(*c*), four rail like ridges (protrusions) 20*a'* are formed in the inner wall at the end of the first cane body 20*a*. In contrast, as shown in FIGS. 7(*b*) and 7(*d*), four prongs (depressions) 20*b'* for receiving the ridges 20*a'* are formed at the end of the first cane body 20*a*. The number of the ridges 20*a'* and the number of the prongs 20*b'* are given as an example, and those numbers may be more or less than this.

Although this embodiment also has the same structure as FIG. 7(*b*) in terms of the connection part between the second cane body 20*b* and the third cane body 20*c*, and the connection part between the third cane body 20*c* and the fourth cane body 20*d*, at least only any one of the connection parts including the connection part between the first cane body 20*a* and the second cane body 20*b* may have the structure shown in FIG. 7(*b*) etc. In such a case, other connection parts may be connected by a robust connection so that a mutual rotation is avoided while the cane is used.

Figure 8:
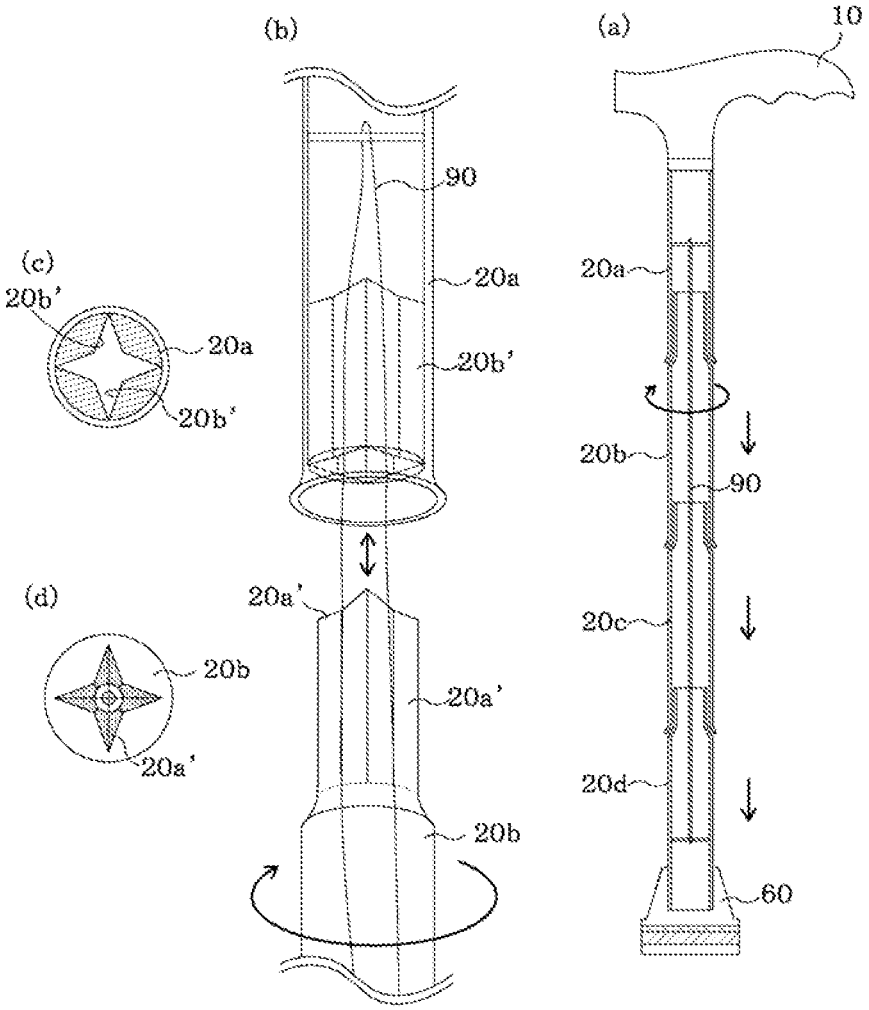
FIG. 8 shows a schematic diagram illustrating an alternative example of the cane of FIG. 7.

Such connection parts may be similar to that of the above described connection part in terms of structure, and may have a shape as shown in FIG. 8 for example. In essence, as long as the rotation between any of those cane bodies and the subsequent retaining against rotation can be realized, it is not limited to those shown in FIG. 7 and FIG. 8.

Embodiment 8

Figure 9:
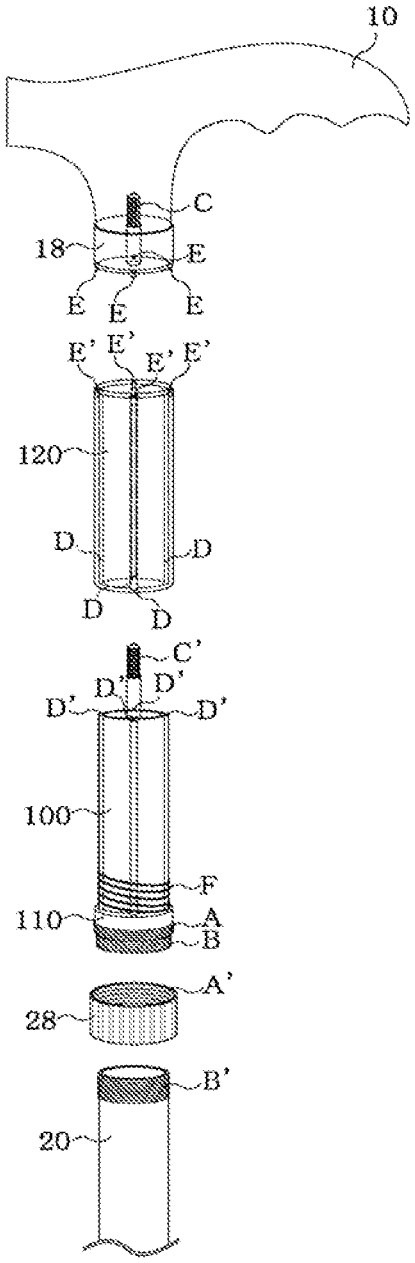
FIG. 9 shows a schematic diagram of the cane of Embodiment 8 according to the present invention.

FIG. 9 shows a schematic exploded perspective view of the cane of Embodiment 8 according to the present invention. The cane shown in FIG. 9 is provided with, for example, four protrusions E at the bottom of the base 18 located at the lower end of the grip part 10. In addition, a screw hole C for receiving the after-mentioned shaft C' is formed in the center of the lower end of the grip part 10.

A pipe-shaped socket 120 is located at the lower end of the grip part 10. For example, four guide grooves D are formed along the axial direction of the socked 120 in its inner wall. In addition, depressions E' for receiving protrusions E are formed at the upper end of the socket 120.

A cylindrical socket receiver 100 is located at the lower end of the socket 120. The socket receiver 100 has a shaft C' extending upward from the center of its top surface. Rail parts D' are formed in the side of the socket receiver 100 at the locations corresponding to the guide grooves D.

In addition, the socket receiver 100 is configured so that a spring F is located at the bottom. The lower end of the spring F is defined by the base 110 of the socket receiver 100. A screw-threaded section A for receiving the cap 28 is formed in the outer wall of the base 110, and a screw-threaded section B for receiving the first cane body is formed in the inner wall of the base 110.

The upper end of the cap 28 receives the lower end of the socket 120. The inner wall of the cap 28 is screwed with the screw-threaded section A of the base 110. The cap 28 prevents the socket 120 from sliding downward even if unexpected external force is applied from the top to the socket 120.

Although the first cane body 20 is similar to those of the above-described embodiments, a screw-threaded B' that is screwed with the screw-threaded section B' of the base 110 is formed herein.

Next, an example of the use of the cane shown in FIG. 9 is described. The cane shown in FIG. 9 has the grip part 10 and the socket receiver 100, which are connected with each other through the screw hole C and the shaft C'. Normally, the socket 120 is pushed upward by the spring F, and the protrusions E of the base 18 and the depressions E' of the socket 120 are connected with each other in the status that those are aligned with each other. Thus, the grip part 10 and the socket receiver 100 will not normally rotate in relation to each other.

In addition, when the socket 120 is received by the socket receiver 100, the rail parts D' of the socket receiver 100 and the guide grooves D of the socket 120 correspond with each other, and thus the socket 120 and the socket receiver 100 will not normally rotate in relation to each other. Moreover, since the socket receiver 100 is connected with the first cane body 20 through the base 110, the socket receiver 100 and the first cane body 20 will not rotate in relation to each other. Thus, each part shown in FIG. 9 will not normally rotate in relation to each other.

Next, when changing the setting position of the rubber tip 60 in relation to the ground etc., the cap 28 is made loose and then the socket 120 is pushed downward. Thereby, the connection between the protrusions E of the base 18 and the depressions E' of the socket 120 is released. Therefore, in the status of the socket 120 being pushed downward, when the grip part 10 is rotated in relation to the socket 120, the screw hole C and the shaft C' will rotate. Thus, the setting position of the rubber tip 60 in relation to the ground etc. can be changed by, for example, rotating the grip part 10 in relation the socket 120 by 90 degrees.

Embodiment 9

Figure 10:
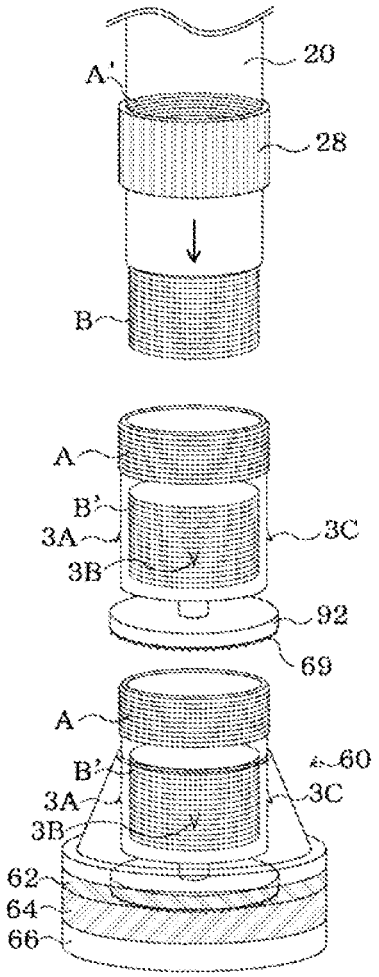
FIG. 10 shows a schematic diagram of the cane of Embodiment 9 according to the present invention.

FIG. 10 shows a schematic exploded perspective view of the cane of Embodiment 9 according to the present invention. FIG. 10 shows an exploded perspective view of the rubber tip 60. The cane shown in FIG. 10 is suitable for replacing the rubber tip 60.

The cane shown in FIG. 10 is provided with a cap 28 wherein a screw-threaded section A' is formed in the inner wall near the lower end of the second cane body 20, and a screw-threaded section B is formed in the outer wall at the lower end of the second cane body 20. On the other hand, in the phase of manufacturing, the rotation auxiliary part 31 embedded inside the rubber tip 60 is provided with a screw-threaded section A that is screwed with the cap 28 in the outer wall at the upper end thereof, and a screw-threaded section B' that is screwed with the screw-threaded section B in the inner wall thereof. In addition, a plurality of nail parts 3A-3C are formed on the outer wall of the rotation auxiliary part 31 to prevent the rotation in relation to the rubber tip 60.

In the cane shown in FIG. 10, the second cane body 20 and the rotation auxiliary part 31 are screwed together with the screw-threaded section B and the screw-threaded section B'. In this status, tightening the cap 28 prevents the screw-threaded section B and the screw-threaded section B' from coming loose. Subsequently, when the rubber tip 60 is worn out by using the cane, if the replacement information plate 92 is exposed after several changes of the contact surface between the rubber tip 60 and the ground etc. as described above, the cap 28 can be easily replaced by loosening the cap 28 and then loosening the screw-threaded section B and screw-threaded section B'.

Although examples of various canes are explained as above, those with the corresponding parts in each drawing replaced with each other should also be included in the scope of the present invention. That means, a cane wherein the rubber tip 60 etc. shown in FIG. 3 is replaced with the rubber tip 60 etc. shown in FIG. 10 should also be included in the scope of the present invention.

The invention claimed is:

1. A cane comprising:

(a) a first cane body, a second cane body, and a third cane body, wherein the first cane body has a plurality of first depressions axially aligned on a lower end thereof, wherein the second cane body has a first protrusion on an upper end thereof, and wherein the first protrusion is fitted by button or screw into any of the first depressions;

(b) a cap attached to retain a connection part between the first cane body and the second cane body, wherein the connection part is defined by an area where the first protrusion is fitted into any of the first depressions;

(c) a grip part located at an upper end of the first cane body;

(d) a rubber tip, located at a lower end of the third cane body and having a colored indicia indicating the degree of wear of the rubber;

(e) a rotating part that rotates the third cane body to four distinct positions relative to the second cane body; and (f) a fixing part that fixes the third cane body and second cane body after those have been rotated by the rotating part, wherein the rotating part and fixing part further comprise a plurality of second depressions circumferentially aligned in a lower end of the second cane body and a second protrusion on an upper end of the third cane body that is fitted by button or screw into any of the second depressions, wherein the rotating part rotates the protrusion along the circumferential line of the depressions so that the height of the cane body remains constant.

2. The cane as claimed in claim 1, wherein the rubber tip is screwed onto the third cane body.

* * * * *